United States Patent [19]

Zacharias

[11] 4,215,855

[45] Aug. 5, 1980

[54] COOLING BED FOR ELONGATE ARTICLES

[75] Inventor: Theodor Zacharias, Meerbusch, Fed. Rep. of Germany

[73] Assignee: Firma Friedrich Kocks GmbH & Company, Dusseldorf, Fed. Rep. of Germany

[21] Appl. No.: 7,319

[22] Filed: Jan. 29, 1979

[30] Foreign Application Priority Data

Mar. 23, 1978 [DE] Fed. Rep. of Germany ..... 2812777

[51] Int. Cl.[2] ..... C21D 9/00

[52] U.S. Cl. ..... 266/259; 266/274

[58] Field of Search ..... 266/259, 274

[56] References Cited

U.S. PATENT DOCUMENTS 1,484,665 2/1924 Nelson ..... 266/259

*Primary Examiner*—R. Dean

*Attorney, Agent, or Firm*—Buell, Blenko & Ziesenheim

[57] ABSTRACT

A cooling bed for cooling and straightening rods or bars which are delivered hot from a rolling mill as side-by-side conveyor chains provided with projections between which pockets for the articles are defined. Reversal sprocket wheels at the infeed end are interconnected so that the pockets at the infeed end remain accurately in alignment, notwithstanding chain wear and differential expansion under the heat conditions. Reversal sprocket wheels at the discharge end are not drivingly interconnected, at least under normal operating conditions. Individual hydraulic drive motors drive the reversal wheels as shown or separate drive wheels which cooperate with the lower runs of the conveyor chains to keep the upper runs taut individually. The individually driven sprocket wheels are mounted with angular lost motion on a connection shaft to avoid one of the motors being overloaded under exceptional circumstances.

14 Claims, 2 Drawing Figures

COOLING BED FOR ELONGATE ARTICLES

Figure 1:
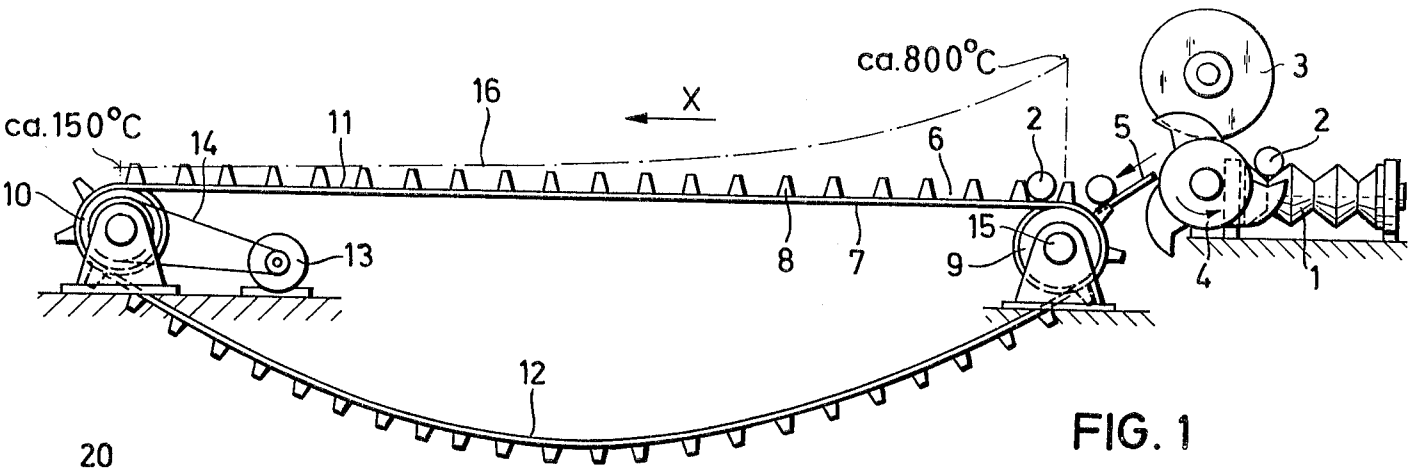

This invention relates to a cooling bed for elongate articles and particularly to a cooling bed for the cooling and straightening of elongate articles, such as bars or rods delivered hot from a rolling mill, in which a number of endless spaced chains for transporting the articles are arranged adjacent and parallel to one another and are supported by means of reversal wheels in the manner of a conveyor belt, the chains having a plurality of projections which form pockets therebetween for receiving the articles.

In the known cooling beds of this type, the reversal wheels are not in any way coupled to one another in the region of the station at which the articles are fed, rather they are idler wheels which rotate independently and whose rotational speed is only dependent upon the feed movement of the associated chains. The chains are in each case driven by those reversal wheels which are arranged in the region of the station at which the articles are discharged and which are driven by a motor. These reversal wheels are driven by a common motor by way of a continuous shaft or by way of shaft sections which are coupled to one another so as to be non-rotatable relative to one another and which are equivalent to a continuous shaft, so that all the reversal wheels at the discharge end are driven fully synchronously.

Synchronous driving of all the endless chains of the cooling bed is of importance, since the projections on all the chains, and thus the reception pockets therebetween, must always maintain their positions relative to one another, which means that, viewed in the longitudinal direction of an article, each reception pocket must be accurately aligned with the corresponding reception pockets of all the adjacent chains. An article placed into these reception pockets is then moved along the cooling bed in a direction which is accurately transverse to its longitudinal axis, and is then cooled and is straightened as a result of its rolling movements along fixed rails which bear the weight of the articles and between which the projections extend.

This known construction has the substantial disadvantage that it is not ensured that the reception pockets of the individual chains are at all times in alignment with one another in the region of the station at which the commodity is fed. These errors of alignment result from the fact that the reversal wheels in the form of sprocket wheels at the infeed end are journalled individually, so that synchronous running of the chains can only be obtained at least in the region of the discharge station by way of the interconnected reversal wheels at the discharge end. However, this is insufficient to ensure alignment of the reception pockets, particularly in the region of the guide wheels at the infeed end. The reason for this is that, with a cooling bed length of, for example, 12 to 20 meters, very long chains are subjected to differing amounts of wear and expand to widely differing extents. The latter is caused by the fact that the cooling bed is not normally uniformly occupied, since the lengths of the individual articles generally vary to a considerable extent. The inaccuracies in the spacing caused by differing amounts of wear and thermal expansion accrue in the opposite direction to the feed direction from the synchronously running reversal wheels at the discharge end up to the individually and freely rotating reversal wheels at the infeed end. Consequently, in the known type of construction, the inaccuracies in the spacing and thus the errors in the alignment of the reception pockets of the individual chains are particularly great in the region in which the commodity is fed. Consequently, the articles delivered onto the cooling bed are bent in the reception pockets owing to the alignment error, and, in extreme cases, drop into reception pockets which do not correspond. In such a case, in order to avoid trouble, the relevant length portion of the elongate article has to be placed manually into the correct reception pockets. This work is not only complicated, strenuous and time-consuming, but also involves a risk of accidents.

A further disadvantage of the known construction resides in the fact that the length of such cooling beds is limited, since the total of the spacing inaccuracies increases as the length of the cooling bed increases, and thus also the errors of alignment which finally reach an extent which is no longer acceptable.

An object of the invention is to provide a cooling bed of the type mentioned above which does not have the above-mentioned disadvantages but which will straighten the articles in a substantially improved manner.

In accordance with the invention a cooling bed for the cooling and aligning of elongate articles comprises a number of endless chains arranged side-by-side parallel and adjacent to one another and held by means of reversal wheels in the manner of a conveyor belt for transporting the articles along the upper runs of the chains, the chains having a plurality of projections which form pockets therebetween for receiving the articles, the reversal wheels of all the chains at the infeed end being interconnected so as to be non-rotatable relative to one another, whilst the reversal wheels at the discharge end are not so interconnected, means being provided for individually driving the chains, either via the reversal wheels at the discharge end or via drive wheels which engage the lower run of the conveyor.

Thus, the reception pockets of all the chains of the cooling bed are accurately aligned relative to one another in the region of the feed station, that is to say, exactly at the station where the aligning has to be particularly exact owing to the fact that the article to be cooled is still red-hot and bendable. During assembly of the cooling bed, the reversal wheels at the infeed end are accurately aligned to a predetermined angular position and errors of alignment are avoided by the fact that the reversal wheels are interconnected so as to be non-rotatable relative to one another. Although, in the cooling bed in accordance with the invention, the error in the alignment of the reception pockets gradually increases for the same above-mentioned reasons as the distance between the reception pockets and the reversal wheels at the infeed end increases, the alignment error is still small in the first instance since the distance from the infeed station, and thus from the reversal wheels which are interconnected in the region of this station so as to be non-rotatable relative to one another, is still not very large. If the error of alignment becomes greater as the article approaches the discharge station increases, the article in the meantime has cooled to such an extent, and thus has solidified in a rectilinear form to such an extent that it can no longer be permanently deformed by the inaccuracies of socket pitch spacing which also gradually accrue in the region of the discharge station, and errors of alignment caused thereby. At all events, the article yields resiliently before it again assumes its rectilinear form after having been discharged from the cooling bed. Thus, advantageously, with the construction in accordance with the invention, no error of alignment, or only a negligible error of alignment, which has virtually no effect, occurs in the region of the cooling bed in which the articles are actually straightened, namely approximately in the first third of the cooling bed beyond the infeed end, and a larger error of alignment can only accrue upstream of the discharge station where the cooled articles which have already become resilient are no longer premanently deformed. With the construction in accordance with the invention, it is possible, in an advantageous manner, to construct chain cooling beds of greater length of, for example, 40 meters and in excess thereof, without losing the aligning action which is important in the infeed region. A cooling bed of greater length increases the output of the entire plant including the installations arranged in advance thereof, and thus improves the economy and at the same time improves the straightening action.

By virtue of the fact that the chains are driven individually, each chain is kept taut separately and independently of its instantaneous length. Furthermore, in an advantageous manner, it is possible largely to freely select the spatial arrangement of the drive. Thus, for example, drive wheels engaging the lower run of the chains below the article conveying run can also be used as drive means as well as the reversal wheels at the discharge end. In the construction in accordance with the invention, it is also possible to use chains of differing lengths without providing an additional drive unit. Furthermore, the free choice of the location for the drive and the use of non-interconnected reversal wheels at the discharge end render it possible for the cooling bed to interdigitate with structures arranged therebeyond, such as the free spaces between the rollers of a roller bed, thus substantially facilitating the transfer of the articles from the cooling bed to the discharge roller bed.

It is advisable for the reversal wheels at the infeed end to be interconnected by way of a continuous shaft or by way of shaft portions which are coupled together so as to be non-rotatable relative to one another. There are doubtlessly other possibilities or interconnecting the reversal wheels at the infeed end so as to be non-rotatable relative to one another, although the possibility mentioned above is particularly simple and reliable.

In a preferred embodiment of the invention, the reversal wheels at the discharge end or the drive wheels cooperating with the respective lower runs of the chains are driven by separate motors, preferably hydraulic motors. It is then advisable to connect the hydraulic motors hydraulically in parallel with one another. With a drive of this type, not only is an independent individual drive obtained for each chain, but also the mechanical stresses on the individual chains remain substantially the same, since the load on the individual hydraulic motors is equalized by way of the hydraulic system. Thus, the expansion behavior of the chains also becomes more uniform, which is in turn advantageous with respect to the accuracy of alignment. Thus, optimum conditions remain in existence for a long period of time. A further advantage of the hydraulic drive resides in the fact that a space-saving, inexpensive and reliable overload safety device for faults can be fitted. Furthermore, the speed of the chains can be conveniently regulated over a wide range. Finally, the hydraulic drive offers the possibility of arranging the hydraulic system, which requires frequent servicing, at a station outside the region of the cooling bed and thus to render the system easily accessible and to protect it against the rough conditions on the cooling bed.

It has proved to be advantageous for the reversal wheels at the discharge end, or the drive wheels cooperating with the respective lower runs of the chains, to be mounted with limited angular play or lost motion on a connection shaft which interconnects at least two adjacent, individually driven reversal or drive wheels. This connection shaft does not transmit any torque during normal operation, since the drive motors do not act upon the respective reversal wheel or drive wheel by way of the connection shaft, but in practice, act upon them by way of an interposed belt or chain drive or a reduction gear. Since the adjacent reversal or drive wheels are driven at the same speed by their motors, and the angular lost motion connection is provided which compensates for small inaccuracies of the drive, the connection shaft rotates loosely with the wheels during normal operation without transmitting torque. It is only if one of the drive chains should become sluggish or should jam through some special circumstance, so that the rotational speed of the relevant reversal or drive wheel drops and it is overtaken by its adjacent reversal or drive wheels, that the angular lost motion would in the first instance be reduced up to the stop provided and then torque would commence to be transmitted from the adjacent reversal or drive wheel or wheels by way of the connection shafts, so that the drive torques would thereby be equalized in the first instance. If the sluggishness is only temporary, the angular lost motion or play is re-established after a short period of time and the torque ceases to be transmitted by way of the connection shafts. On the other hand, if the reversal or drive wheel under consideration is fully jammed, the entire drive of the cooling bed is overloaded and is switched off by way of the safety devices, such as a hydraulic excess pressure valve, without any appreciable damage to the commodity or the cooling bed and its drive. Alternatively, other connection means such as gear wheel stages or suitable clutches can be provided instead of connection shafts.

In conjunction with the last-mentioned features, it is advisable to associate with the means providing for the limited angular lost motion, or with the connection shaft, a warning device which optically and/or acoustically indicates transmission of torque by way of the connection shaft. By way of example, this can be effected by means of pole wheels and magnetic sensors which are associated therewith and by means of which it can be very rapidly ascertained whether the rotational speed of one of the reversal or drive wheels differs from the rotational speeds of the other wheels. A warning device of this type could also then be connected to a device for stopping the entire drive.

Figure 2:
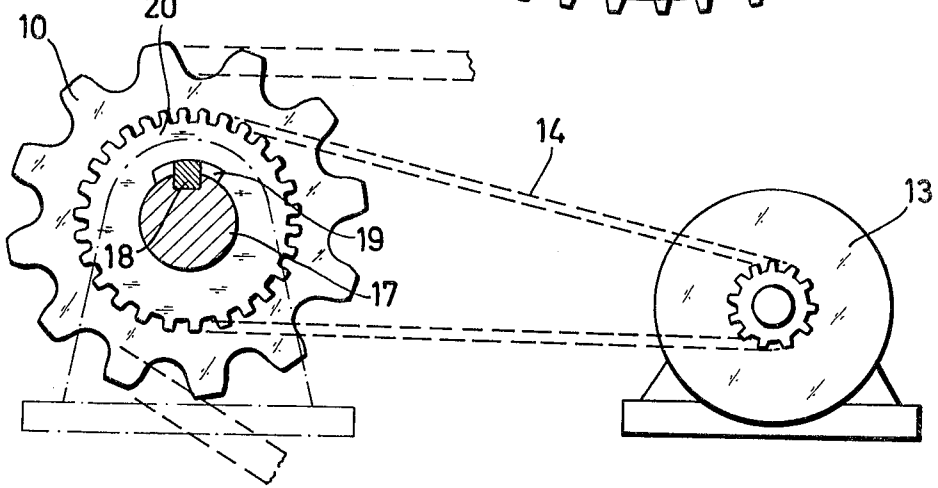

The invention is further described, by ways of example, with reference to the diagrammatic drawings, in which:

FIG. 1 is a cross section through a chain cooling bed together with drive; and FIG. 2 shows the discharge end of the cooling bed of FIG. 1, drawn to a larger scale.

A delivery roller bed 1 (FIG. 1) delivers elongate articles 2 in the form of round bars or rods which are delivered from a rolling mill (not illustrated) and which have been cut to predetermined lengths and possibly residual portions by a saw 3 arranged downstream of the rolling mill. Each article 2 is lifted from the roller bed 1 onto an inclined plane 5 by means of rotary star wheels 4 (only one of which is visible in FIG. 1) which are arranged in tandem and engage between the rollers of the roller bed 1, so that the commodity 2 in each case drops into a row of reception pockets 6 of conveyor chains 7, a number of which are arranged side-by-side in spaced parallel relationship, only the chains 7 being visible in FIG. 1. The reception pockets 6 of the chains 7 are defined between a large number of projections 8 which are component parts of the individual chain links.

The chains 7 are endless and are held in the manner of a conveyor belt by means of reversal sprocket wheels 9 and 10, so that an upper run 11 and a lower run 12 are produced. Only the reversal wheels 10 are driven by respective motors 13 by way of drive chains 14. However, the chains 14 could be replaced by drive belts or drive shafts. Alternatively, each motor 13 could be coupled as a flange or hub motor directly to the reversal wheel 10. A flange motor is a motor whose housing has at one end a flange by which the motor is mounted and a hub motor is a motor whose casing is rotatable and forms a wheel hub and whose shaft does not rotate. The direction of rotation of the motors 13 and of the reversal wheels 10 is such that the articles 2 are conveyed in the direction of the arrow X perpendicular to the longitudinal axes of the articles.

Since a plurality of chains 7 are arranged parallel and adjacent to one another, a corresponding number of reversal wheels 9 and 10 are also located adjacent to one another. The reversal wheels 9 at the infeed end are arranged on a common shaft 15 by means of which they are coupled to one another so as to be non-rotatable relative to one another. The teeth of the reversal wheels 9 which engage the chains 7 are accurately aligned during assembly, so that it is assured, and remains assured, that the reception pockets 6 of all the chains 7 are accurately aligned with one another in the region of the reversal wheels 9 at the infeed end and extend parallel to the axis of rotation of the shaft 15. Such assurance does not apply in the region of the reversal wheels 10 at the discharge end, since the individual chains 7 are subjected to different amounts of wear and are also heated to different extents and expand to different extents owing to differing thermal stresses resulting from the differing lengths of the articles 2. In order to take this into account, the reversal wheels 10 at the discharge end of the cooling bed are not rigidly interconnected, but are in each case individually driven by a separate motor 13. Consequently, the reception pockets 6 are no longer necessarily accurately aligned in the region of the discharge station, this not even being obtainable with economically justifiable means with an upper run length of, for example, more than 30 meters. However, in the cooling bed in accordance with the invention, these errors of alignment occur in the region of the discharge end, that is in the region where the articles 2 have already been extensively cooled and have solidified to a considerable extent, so that, in any case, they have become resiliently deformable so that they become straight again after being discharged from the cooling bed. The articles 2 attain their straight form in the region of the infeed end of the cooling bed, particularly in the first third of the upper run length, that is, at the region where the articles 2 are still very hot and are readily deformable. The temperature curve is plotted in the form of a dash-dot line in FIG. 1 and is designated 16. It will clearly be seen that the articles cool very rapidly in the first third of the upper run length adjacent the infeed end, and thus solidify precisely in the region where the reception pockets 6 are still in alignment and the articles 2 are aligned rectilinearly. The errors of alignment only increase gradually towards the reversal wheels 10 at the discharge end when the articles 2 have already solidified such that the errors of alignment occurring can, at the most, cause resilient deformation which reforms upon the discharge of the articles 2.

As is shown particularly in FIG. 2, the reversal wheels 10 at the discharge end are interconnected by means of a connection shaft 17, although they are not rigidly connected thereto but by way of keys 18 and particularly wide keyways 19 in the sprocket wheels 20 which are in turn coupled to the guide wheels 10 so as to be non-rotatable relative thereto, the drive chains 14 being entrained about the sprocket wheels 20. The drive torque is transmitted from the motors 13 by the drive chains 14 to the sprocket wheels 20 and then directly to the reversal wheels 10 and thus to the chains 7 of the cooling bed. The connection shaft 17 does not participate in this transmission of torque. The angular play or lost motion provided as the keyway 19 corresponds to approximately half the reception pocket pitch in each direction from the mid-position illustrated and is only reduced when, for some reason or other, one of the chains 17 loads its drive motor 13 to a greater extent than is normal and consequently the rotational speed of that motor is slightly reduced. As soon as the key 18 comes into abutment with one face of the keyway 19, this also being the case with the adjacent sprocket wheels 20, an additional torque is transmitted by way of the connection shaft 17 and equalization of load takes place between the drive motors 13 of the cooling bed. If the sluggishness is only temporary, the one cooling bed chain 7 is pulled along by the others in this manner and the operation of the cooling bed is not impaired, and, in particular, the articles 2 are not distorted by a lagging chain 7. A warning device (not illustrated) could draw the attention of the operating personnel to this operating state of the cooling bed, so that prompt measures can be taken to re-establish the normal operating state.

In an alternative arrangement the reversal wheels 10 at the discharge end are idler wheels and are not interconnected. In this case, individually driven drive wheels cooperate with the lower runs 12 of the conveyor chains. This arrangement is useful in that the reversal wheels 10 can also be arranged between individual rollers of a roller conveyor.

In the foregoing specification I have set out certain preferred practices and embodiments of my invention; however, it will be understood that this invention may be otherwise embodied within the scope of the following claims.

I claim:

1. A cooling bed for the cooling and straightening of elongate articles comprising at least two endless chains arranged side-by-side parallel and adjacent to one another extending from an infeed and adjacent a delivering means to a discharge end remote therefrom and held by means of reversal wheels in the manner of a conveyor belt having upper and lower runs for transporting the articles delivered thereto along the upper runs of the chains, the chains having a plurality of projections which form pockets therebetween for receiving the articles, a number of reversal wheels at said infeed end corresponding to the number of endless chains, said reversal wheels at the infeed end being interconnected, so as to be non-rotatable relative to one another, a like number of reversal wheels at the discharge end, said reversal wheels at the discharge end being not so interconnected, and means spaced from the reversal wheels at the infeed end individually driving the chains.

2. A cooling bed as claimed in claim 1 wherein the means for individually driving said chains is a drive means acting through the reversal wheels at the discharge end.

3. A cooling bed as claimed in claim 1 wherein the means for individually driving said chains are drive wheels engaging the lower run of each chain.

4. A cooling bed as claimed in claims 1, 2 or 3 in which the reversal wheels at the infeed end are interconnected by way of a common continuous shaft.

5. A cooling bed as claimed in claims 1, 2 or 3 in which the reversal wheels at the infeed end are interconnected by way of shaft portions which are coupled together so as to be non-rotatable relative to one another.

6. A cooling bed as claimed in claim 1 or 2 in which the individual drive means combined individual motors which drive the reversal wheels at the discharge end.

7. A cooling bed as claimed in claims 1 or 3 in which the individual drive means combine individual motors which drive the drive wheels.

8. A cooling bed as claimed in claims 6 or 7 in which the drive motors are hydraulic motors.

9. A cooling bed as claimed in claim 8 in which a hydraulic system for the hydraulic motors connects the latter in parallel with one another.

10. A cooling bed as claimed in claims 1 or 2 in which angular lost motion connections are provided between the individually driven reversal wheels at the discharge end.

11. A cooling bed as claimed in claims 1 or 3 in which angular lost motion connections are provided between the individually driven drive wheels at the lower runs of said chains.

12. A cooling bed as claimed in claim 11 in which the individually driven wheels are mounted with limited angular play on a connection shaft which interconnects at least two adjacent, individually driven wheels.

13. A cooling device as claimed in claim 12, in which a warning device is associated with the angular lost-motion connections and indicates transmission of torque through the lost motion connection.

14. A cooling bed as claimed in claim 10 in which the individually drive wheels are mounted with limited angular play on a connection shaft which interconnects at least two adjacent, individually driven reversal wheels.

* * * * *

UNITED STATES PATENT AND TRADEMARK OFFICE

CERTIFICATE OF CORRECTION

PATENT NO. : 4,215,855

DATED : August 5, 1980

INVENTOR(S) : Theodor Zacharias

It is certified that error appears in the above-identified patent and that said Letters Patent are hereby corrected as shown below:

Column 3, line 10, "premanently" should read --permanently--.

Column 3, line 42, "or" should read --of--.

Signed and Sealed this

*Eighteenth* Day of *November 1980*

[SEAL]

*Attest:*

SIDNEY A. DIAMOND

*Attesting Officer*

*Commissioner of Patents and Trademarks*